US006164258A

United States Patent [19]

Petrovich et al.

[11] Patent Number: 6,164,258

[45] Date of Patent: Dec. 26, 2000

[54] DIESEL ENGINE STARTING CONTROLLER AND METHOD

[75] Inventors: Paul A. Petrovich, Fowlerville; John J. Schmitz, St Clair Shores; A. David Stormer, Clinton Township; Jack G. Rodgers, Roseville, all of Mich.

[73] Assignee: The United States of America as represented by the Secretary of the Army, Washington, D.C.

[21] Appl. No.: 09/336,102

[22] Filed: Jun. 18, 1999

Related U.S. Application Data

[63] Continuation-in-part of application No. 09/030,519, Feb. 23, 1998, abandoned.

[51] Int. Cl.[7] ..... F02B 9/08; F02N 17/00

[52] U.S. Cl. ..... 123/179.6; 123/145 A

[58] Field of Search ..... 123/179.3, 179.6, 123/179.21, 145 A; 701/102; 219/501, 506; 340/640

[56] References Cited

U.S. PATENT DOCUMENTS

| | | | |
|---|---|---|---|
| 4,080,537 | 3/1978 | Bucher | 123/179 B |
| 4,658,772 | 4/1987 | Auth et al. | 123/145 A |
| 5,287,831 | 2/1994 | Andersen et al. | 123/179.3 |
| 5,307,701 | 5/1994 | Thonnard | 123/145 A |
| 5,327,870 | 7/1994 | Boisvert et al. | 123/145 A |
| 5,413,072 | 5/1995 | Andersen et al. | 123/145 A |

*Primary Examiner*—Tony M. Argenbright
*Assistant Examiner*—Mahmoud M Gimie
*Attorney, Agent, or Firm*—Peter A. Taucher; Gail S. Soderling

[57] ABSTRACT

A starting controller for a diesel engine. The controller has a microprocessor that will provide a current to the glow plugs until they are heated to the desired operating temperature and will then distribute sequential pulses to the individual plugs until the engine reaches the desired operating temperature. The system can have a latching circuit that will prevent the preglow cycle from being reinitiated until the glow plugs have been allowed to cool to a level where reinitiation will not represent a substantial degrading effect on the glow plugs.

3 Claims, 2 Drawing Sheets

DIESEL ENGINE STARTING CONTROLLER AND METHOD

CROSS REFERENCE TO RELATED APPLICATIONS

This application is a Continuation-in-Part of application U.S. Ser. No. 09/030,519; filed Feb. 23, 1998 now abandoned.

GOVERNMENT INTEREST

The invention described herein may be made, used and licensed by or for governmental purposes without paying us any royalty.

BACKGROUND OF THE INVENTION

1. Field of the Invention

In one aspect this invention relates to diesel engine controls. In a further aspect this invention relates to diesel engine starting systems.

2. Prior Art

In general, diesel engines require the use of a starting aid particularly when engine starting is attempted in cold weather. The starting aid is used until there is sufficient heat in the cylinder area to sustain knock ignition combustion. At present two different methods are normally used to aid diesel engine starting. One method is ether injection, which provides a source of ether to the combustion chamber, the ether is highly combustible and causes fuel ignition even at low temperatures. This however requires that the ether supply be replenished and adds another fluid to be maintained. Such systems are also very expensive to install making them unsuitable for smaller engines where cost is a important factor.

A second method is to provide a glow plug or similar device which is heated to a temperature that will ignite at least a portion of any fuel injected into the combustion cylinder. The glow plugs continue to assist in igniting fuel until the combustion cylinder has reached a satisfactory operating temperature for knock ignition. The glow plugs can be heated after the engine has started operation to assist fuel combustion thereby minimizing the production of incomplete combustion products. Glow plug starting systems generally have one or more glow plugs associated with each combustion cylinder, a controller circuit to provide electrical current to the glow plug and a power source.

In greater detail, the most traditional prior art system for diesel engine control would include: a glow plug controller which acts through another control box containing a relay connection, the relay in turn activates the glow plugs, starter and related accessories. In such a system upon cold starting, the relay will engage and the glow plugs are activated for a set period of time to attain an operating temperature and then the starter is engaged. The engine is cranked L11 until it starts and assumes normal operation, or the starter is deactivated. During the start cycle, the relay is periodically energized to keep the glow plug temperature near the desired operating temperature of 1800 to 1900 F (about 1000 to 1050 C). The relay cycling provides short, intense pulses of power to all the glow plugs simultaneously. This pulsed after glow sequencing, is maintained during the first few minutes of engine operation which helps reduce pollution and makes for a smoother initial operation. However, this after glow sequencing which activates all plugs simultaneously creates a large electromagnetic impulse, EMI, power surge each time the relay is cycled. Power surges of a magnitude in the 100 amp range for one second are common with the pulses being delivered every 5 to 10 seconds. The cycle time and frequency depend on the starting protocol programmed into the controller. The EMI surges create problems with radio systems on the vehicle and also the other electrically controlled systems on the vehicle.

Prior art systems are generally designed so the duty cycle is dependant on the temperature of a portion of the engine or cooling system at a location removed from the glow plugs. When the engine does not start promptly, the ignition is generally turned off and the starting sequence reinitiated. Since the temperature sensed by the controller has not generally changed markedly, the system will default to its cold start mode and the glow plugs will be reactivated for the full power preglow cycle of the starting protocol. Repeated use of the full power preglow cycle without an adequate cool down period, exposes the glow plugs to premature failure from overheating since the glow plugs are not designed to take the full power preglow energy cycle without a rest period. This type of failure is particularly a problem with many commercial and heavy equipment systems that are powered by 24 volt electrical systems. The higher voltage will over heat the glow plugs faster than 12 volt systems if the plugs preglow cycle is repeated without adequate rest time between cycles since most glow plugs are designed for 12 Volt systems. Failure modes from over heating range from the plugs simply burning out to the heating element breaking inside the engine head. A broken plug failure expands the glow plug element to the point where it can not be removed from the head using normal techniques and requires disassembly of the engine for repair.

It is desirable to create a starting assist system which will both ensure an adequate rest time between repeated preglow cycles and is not temperature dependant. Further the system should provide an after glow cycle protocol that maintains an even glow with minimum EMI spikes.

SUMMARY OF THE INVENTION

Briefly the present invention is a starting system for controlling the glow plugs and related starting systems to increase glow plug life and decrease starting emissions pollution. The present system uses a microprocessor to control a number of transistors which in turn allow the glow plugs to achieve the necessary preglow temperature and then are pulsed by the microprocessor to maintain the required operating temperature. In the event of repeated attempts to restart the engine, the controller will ensure that the preglow portion of the cycle is repeated only when the plugs have recovered from a previous pre-glow cycle but will allow the after glow cycle to be reinitiated in the event the engine does not begin operating within the initial after glow period.

DETAILED DESCRIPTION

Figure 1A:
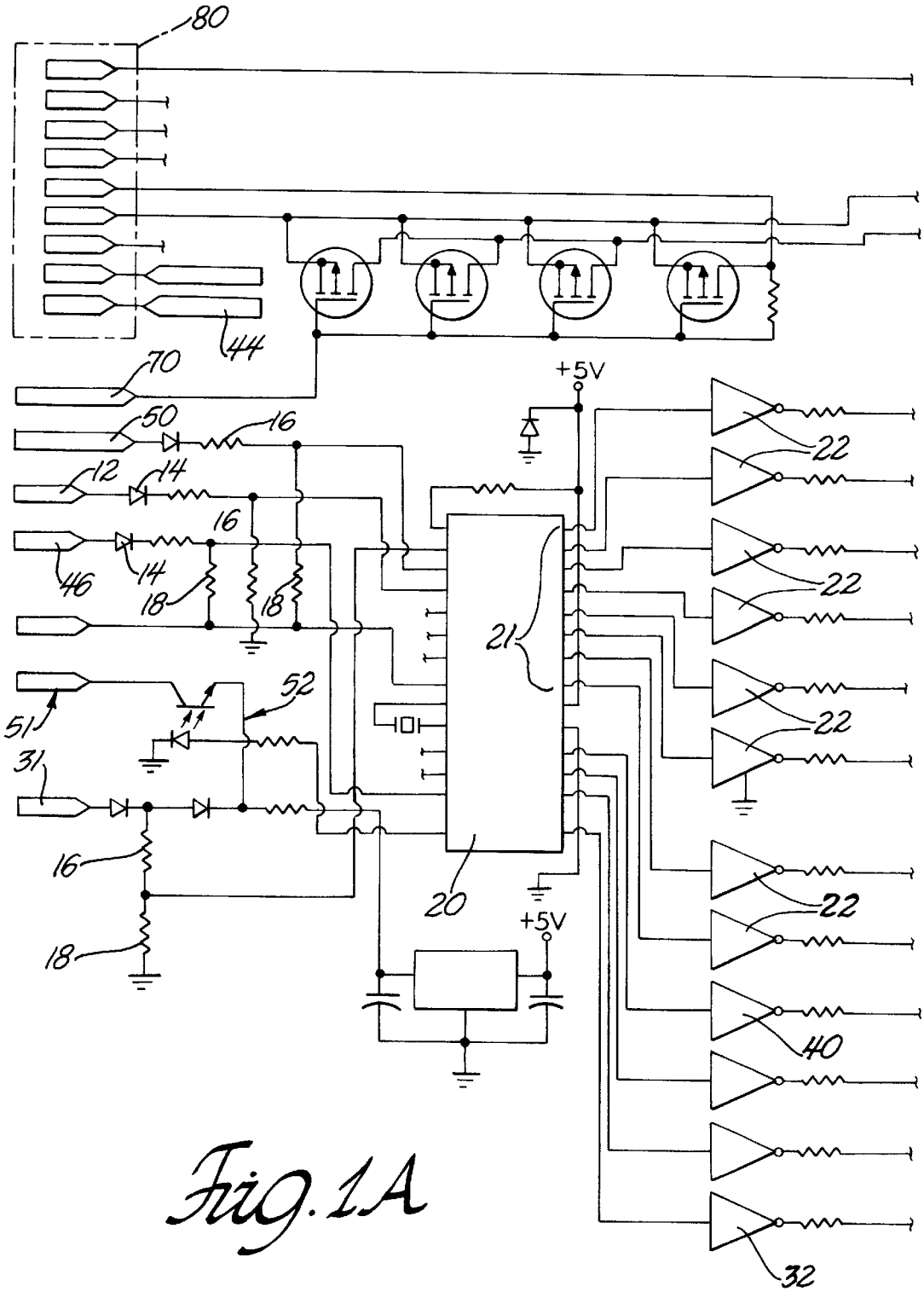
FIGS. 1A and 1B show a schematic of one control unit according to this invention for a vehicle.
Figure 1B:
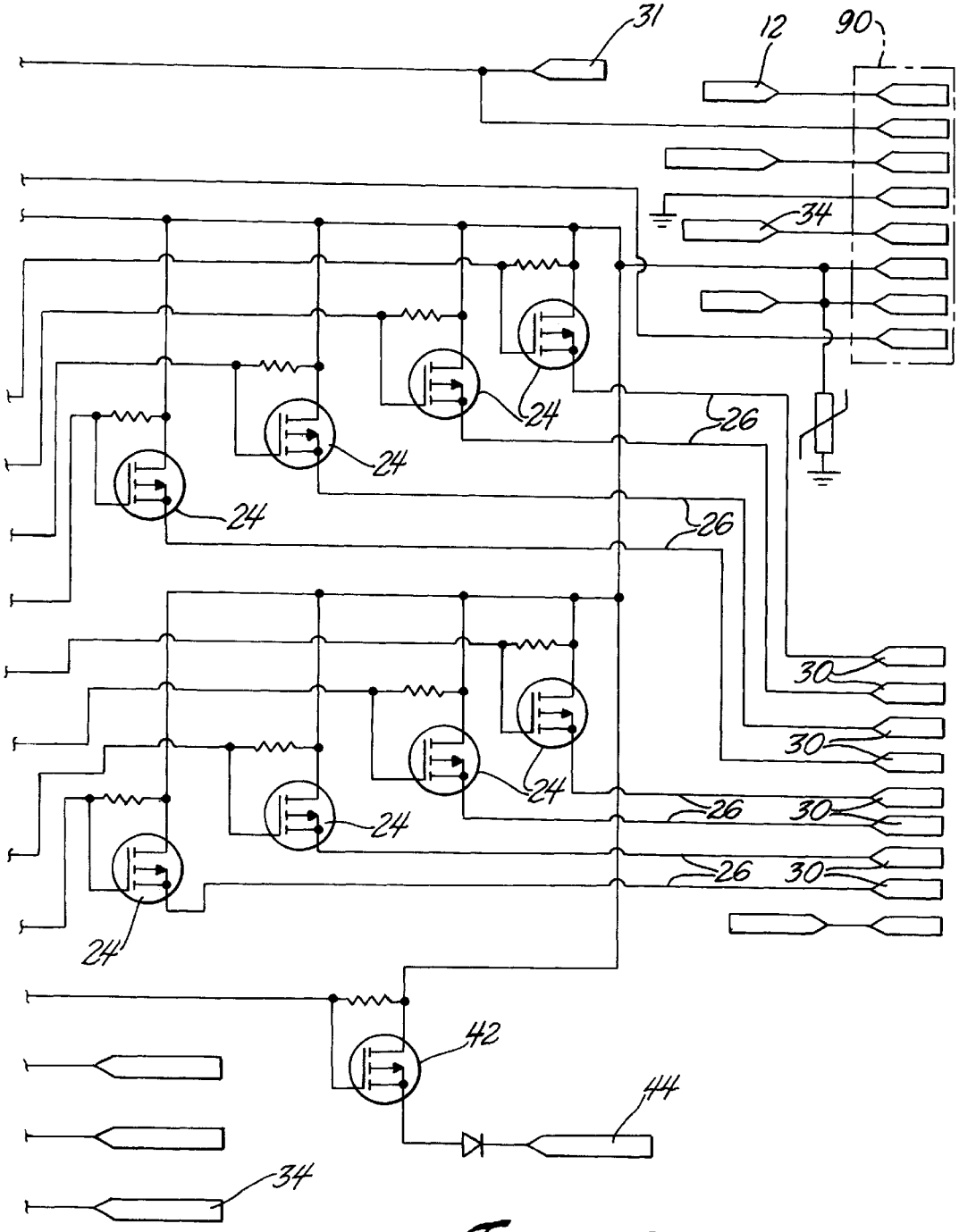

In the accompanying drawing where like numerals refer to like parts, the control system of the current invention is described with respect to a 24 Volt vehicle electrical operating system, common to heavy equipment. To begin the ignition sequence, an on-off switch, such as a toggle switch or key ignition (not shown) is activated. The switch in turn will activate a starting sensor, 12 which transmits a current at 24 Volts to a diode 14 and into a voltage divider formed by a 5.6 K ohm resistor 16 and a 1.0 K Ohm resistor 18. The resulting current at approximately 5 Volts flows through line 18 to an input on a microprocessor 20. This initiates a preprogrammed starting sequence determined by the engine operating characteristics loaded on the microprocessor 20.

Various microprocessors could be used as the processor 20 and are compatible with the present system. One example of a general purpose microprocessor which has been found amenable for use in practicing this invention is the microprocessor designated PIC16C73A manufactured by Microchip. The remainder of this discussion will be based on the inputs-outputs on the Microchip microprocessor. Other microprocessors would have different input-output schemes and designations. However, such microprocessors may also be used in the practice of this invention and their programming altered to fit the operating parameters of the engine being started.

The starting sequence program of this invention is designed for an eight cylinder engine and therefore the starting sequence will activate eight microprocessor outputs 21 on microprocessor 20. As the microprocessor 20 activates the outputs 21, it turns on eight corresponding individual buffers 22 that provide current to activate eight individual transistors 24. There is one buffer and one transistor associated with each glow plug 30 in the engine when using the controller of this invention. Obviously there would be fewer buffers and transistors if there were fewer glow plugs because the engine had fewer cylinders. Each individual transistor 24 delivers current via a line 26 furnished by a battery system (not shown) to the glow plugs 30. The microprocessor 20 will maintain the power to the glow plugs 30 for a calculated length of time to ensure the glow plugs have reached an operating temperature of about 950 C. The preglow time is calculated by the microprocessor 20. Generally, the glow plugs 30 commonly used in diesel engines have about 1.8 Ohm resistance and require about 2000 watt-seconds to reach the required operating temperature. The battery voltage is directly measured by voltage sensor circuit 30 which is connected to the battery system of the vehicle, the battery voltage passing through a voltage divider of the type described above and the output voltage delivered to an input on the microprocessor 20. At the start of the cycle the required pre-glow time is calculated using the formula (2000 watt seconds times 1.8 Ohm divided by the measured voltage squared). After the calculation, the microprocessor 20 will maintain the buffers 22 in an activated state for the calculated time period to maintain a constant current flow to the glow plugs 30 and to elevate the glow plugs to the desired temperature. During this time, the microprocessor 20 will also activate a buffer 32 which will in turn energize a wait to start light 34 located on the vehicle control panel. The wait to start light 34 will warn the operator that the engine is not ready for starting and the starter should not be engaged.

When the calculated preglow time has elapsed, the microprocessor will turn off the current to the wait to start light 34 signaling the operator that the starter can be engaged. At the same time the microprocessor will begin an after glow cycle to maintain the glow plugs temperature.

The after glow cycle should maintain the glow plugs at the approximately 950 C temperature until the engine has achieved a smooth operating temperature. It is estimated that pulses of 40–60 Watts per plug will maintain the glow plugs at their desired operating temperature until the engine starts and reaches operating conditions. Using a predetermined power value, Wattage, and the measured Voltage, the microprocessor can calculate the pulse width and spacing to be applied to each individual glow plug 30 to maintain each individual plug at the desired operating temperature. An acceptable afterglow duty cycle can be calculated using the formula (50 Watts times 1.8 Ohm divided by the measured voltage squared). The microprocessor 20 will sequentially activate the individual buffers 22 to deliver the required power pulse to each glow plug in sequence. As the current to one plug is being turned off the next plug in sequence will be turned on so the sequencing procedure will maintain a nearly constant current flow to the glow plugs throughout the after glow cycle. Sequentially applying current the plugs in a rotating fashion will smooth the current flow by reducing current surges and thereby reduce EMI surges resulting from current flow variations. It will also prevent current surge drains on the battery system which were the result of operating systems utilizing temperature controlled-relay systems. It is expected the afterglow pulses will generally be applied to the glow plugs for 1 to 2 minutes after the pre-glow cycle is complete. This after glow cycle will assist in smoother starting and also lowers emissions during the initial operating cycle until the engine block achieves operating temperature. The after glow cycle will stay on for the predetermined length of time.

After the wait to start light has been turned off by the microprocessor 20 and the after glow cycle initiated, the starter switch can be moved to the engine cranking position to begin engine cranking. The microprocessor 20 will energize buffer 40, which in turn will activate a transistor 42, which acts as a 24 volt switch. The current through transistor 42 activates the starter solenoid 44 causing the starter to crank the engine. The microprocessor 20 can be programmed to lock out the starter solenoid 44 until the pre-glow cycle has been completed to prevent premature starting attempts; however, this is not necessary for most applications.

An alternator tap 46 senses the voltage produced by the engine's alternator. Once the engine begins to operate, the alternator generates a 24 Volt current which passes through a voltage divider and provides a 5 volt current to the microprocessor 20 signaling the microprocessor that the engine is functioning sufficiently that battery power to the starter can be turned off and the starter solenoid 44 disengaged.

A latching circuit 51, powered by the battery contains a switch element 52 with a light emitting diode 54 that is controlled by the microprocessor 20 to remain lit for a predetermined period after run switch starter has been turned off. Generally, the diode will remain lit for about 2 to 3 minutes. The latching circuit 54 will prevent the pre-glow cycle from being reactivated until the delay period has expired and the latching circuit is turned off. If the engine failed to start within the after glow period, the run switch can be turned off and back on. If the restart attempt takes place while the latching circuit 51 is active, the microprocessor 20 will default to the after glow cycle and maintain the glow plugs near their operating temperature.

The latching circuit 51 ensures the glow plugs are not subjected to the higher wattage pre-glow cycle for several minutes after a pre-glow activation. The latching circuit 51 provides the glow plugs 30 with a predetermined minimum rest time to recover before the microprocessor 20 will allow the pre-glow cycle to be reinitiated. The rest time preserves the glow plugs 30 from abuse by an impatient operator thereby preventing the most common operator abuse problem. In general a 2 to 3 minute time out is sufficient to allow the plugs to be recycled. The present controller of this invention allows the run switch to activated more than once to initiate starting without the need to time the rest cycles and will prevent operator abuse to the glow plugs.

The foregoing descriptions and calculations are predicated on a diesel engine using a standard 1.8 Ohm resistance glow plug. If glow plugs with different resistances or operating characteristics were used the microprocessor routine can be modified appropriately to provide the required pre-glow wattage and after glow wattage. The times set forth above are for a normal small truck 4 cycle diesel engine. The controller could also be programmed for larger and 2 cycle diesels which have different requirements and operating characteristics.

The bus designated 80 represents the under-hood bus of the circuit, which connects the various elements that make up integral parts of a normal land vehicle electrical system. The circuit has a connection 70 to the vehicle current source be it battery, external power supply or alternator. The line current from the current source is modified where needed by transistors 72 to provide a lower current for certain lamp and similar devices which require only a minor current to operate while the higher current accessories like the fan, heater and starter are furnished a full current load. The bus 80 has a corresponding attachment area designated generally 90, which represents the dashboard side of the electrical system. The bus 80 receives current and distributes it to the various parts of the electrical system as shown. Undesignated leads on the bus can be used for the various vehicle needs, brake lights, heater, air conditioning for example. These are part of the vehicle's normal equipment but are not part of the present invention and description is omitted in the interest of brevity.

Various alterations and modifications will become apparent to those skilled in the art without departing from the scope and spirit of this invention and it is understood this invention is limited only by the following claims.

What is claimed is:

1. A method of starting a diesel cycle engine having a plurality of glow plugs comprising the steps of:

measuring the voltage to be applied to the glow plugs;

calculating a pre-glow time necessary to apply a predetermined number of Watts to the glow plugs to raise the glow plug to an operating temperature;

applying current to the glow plugs for the calculated pre-glow time while simultaneously locking out the starter circuit to prevent premature starting attempts;

initiating engine starter and fuel supply systems after the required pre-glow time has been reached, to begin engine operation;

calculating the time required to provide a predetermined after glow pulse of predetermined wattage to the glow plugs after the pre-glow time to maintain the glow plugs at an optimal operating temperature;

applying current to individual glow plugs in sequence for the calculated time for a predetermined after glow time to help the engine start and reduce the pollutants generated during the initial few minutes of run time while maintaining a nearly constant current flow;

activating a latching circuit upon cessation of the after glow time which prevents reinitiating of the pre-glow cycle for a predetermined period but allows the controller to energize the plugs in the after glow mode should the starter be activated while the protection timer is active.

2. A control system for use in starting a diesel engine having an plurality of glow pugs there being at least one glow plug per cylinder with a source of direct current power source to provide starting energy, including:

a starting switch for activating the control system and provide electrical flow to the engine components;

a voltage sensor which measures the voltage of the direct current power source;

a microprocessor electrically connected to the starting switch and the voltage sensor, the microprocessor adapted to execute a starting protocol in response to the position of the starting switch, the microprocessor taking the measured voltage and a preselected glow plug resistance to calculate a preglow time necessary to raise the temperature of the glow plug to the desired operating temperature, the microprocessor providing an operator signal that the starting switch should be moved to the second, cranking position, after the calculated time has elapsed and a sufficient amount of power has been furnished to the glow plugs, the microprocessor will then provide sequential essentially square wave after glow pulses of energy to individual glow plugs, the after glow pulses of energy being calculated based on the measured voltage from the voltage sensor to maintain the glow plugs at the desired operating temperature for a predetermined time, the after glow pulses being delivered so as to maintain the after glow current at a relatively constant level; and a starter circuit activated by the microprocessor to furnish current to the starter motor and crank the engine until the combustion cycle begins to function unaided.

3. The control system of claim 2 having a latching circuit associated with the microprocessor, the latching circuit being adapted to maintain a current flow to the microprocessor for a predetermined period of time after the starting circuit has been deactivated so as to prevent the reinitiation of preglow for a period of time sufficient to allow the glow plugs to cool from the preglow cycle.

* * * * *